United States Patent [19]

Boehmke et al.

[11] 4,062,643

[45] Dec. 13, 1977

[54] PRINTING PROCESS ASSISTED BY ALKANOLS OF 5 TO 8 CARBON ATOMS, UREA AND MINERAL OIL

[75] Inventors: Günther Boehmke; Richard Schwaebel, both of Leverkusen, Germany

[73] Assignee: Bayer Aktiengesellschaft, Leverkusen, Germany

[21] Appl. No.: 303,402

[22] Filed: Nov. 3, 1972

[30] Foreign Application Priority Data

Nov. 5, 1971 Germany ..... 2154998

[51] Int. Cl.[2] ..... D06P 1/651

[52] U.S. Cl. ..... 8/1 A; 8/25; 8/62; 8/92; 8/94 R; 8/173; 8/93

[58] Field of Search ..... 8/62, 93, 173, 1 A

[56] References Cited

U.S. PATENT DOCUMENTS

| | | | |
|---|---|---|---|
| 2,323,871 | 7/1943 | Kienle | 8/62 |
| 2,332,121 | 10/1943 | Trowell | 8/62 |
| 3,047,353 | 7/1962 | Klein | 8/62 X |
| 3,510,244 | 5/1970 | Schlaginhaufen | 8/62 |

OTHER PUBLICATIONS

An Introduction to Textile Printing, pp. 4–6, Pub. 1964 by I.C.I.

*Primary Examiner*—Donald Levy
*Attorney, Agent, or Firm*—Plumley and Tyner

[57] ABSTRACT

Process for printing cellulosic fibre materials with reactive dyestuffs and/or direct dyestuffs wherein are used emulsion printing pastes which contain, in addition to the dyestuffs and the alkalis required for fixing the reactive dyestuffs a. an alkali salt and/or ammonium salt of a $C_8$–$C_{22}$-carboxylic acid,
b. an aliphatic $C_5$–$C_{18}$-alcohol,
c. a largely straight-chain, liquid paraffin hydrocarbon,
d. urea and optionally
e. an alkali salt and/or ammonium salt of a sulphonic acid.

5 Claims, No Drawings

PRINTING PROCESS ASSISTED BY ALKANOLS OF 5 TO 8 CARBON ATOMS, UREA AND MINERAL OIL

The invention relates to a process for printing cellulosic fibre materials with reactive dyestuffs and/or direct dyestuffs; more particularly it concerns a process for printing cellulosic fibre materials with reactive dyestuffs and/or direct dyestuffs using emulsion thickeners, wherein are used emulsion printing pastes which in addition to the dyestuffs and the alkalis required for fixing the reactive dyestuffs contain a. an alkali salt and/or ammonium salt of a $C_8$–$C_{22}$-carboxylic acid,
b. an aliphatic $C_5$–$C_{18}$-alcohol,
c. a largely straight-chain liquid paraffin hydrocarbon,
d. urea and optionally
e. an alkali salt and/or ammonium salt of a sulphonic acid.

The alkali salts or ammonium salts of $C_8$–$C_{22}$-carboxylic acids, to be used as component (a) according to the invention, are the sodium, potassium or ammonium salts of saturated or unsaturated fatty acids, such as of lauric, myristic, palmitic, stearic, oleic or ricinoleic acid, and the salts of mixtures of saturated and/or unsaturated fatty acids such as occur in rape oil, soya oil, coconut oil, palm kernel oil, tallow fatty acids or the Versatic acids (slightly branched $C_{11}$–$C_{13}$-synthetic fatty acids), and also the ammonium salts of the said acids which are derived from aliphatic or cycloaliphatic amines, such as monoethanolamine, diethanolamine and triethanolamine, propanolamine or cyclohexylamine.

The $C_5$–$C_{18}$-alcohols to be used as component (b) according to the invention are straight-chain or at least only slightly branched aliphatic alcohols, such as n-pentanol, n-hexanol, n-octanol, 2-ethylhexanol, n-decanol, n-dodecanol or oleyl alcohol.

As component (c), they may be mentioned largely straight-chain, liquid paraffin hydrocarbons or paraffin hydrocarbon mixtures of boiling range 80° to 350° C, preferably 170° to 250° C, for example heavy benzine.

The components (e) optionally to be used are the alkali salts, preferably sodium salts and ammonium salts, of sulphonic acids which possess a substantially unbranched alkyl chain, such as n-alkanesulphonic acids, for example $C_{12}$–$C_{15}$-alkanesulphonic acids, n-alkylbenzenesulphonic acids, for example dodecylbenzenesulphonic acid, α-olefinesulphonic acids, α-sulpho-fatty acid esters and acyl-taurides, for example oleoylmethyltauride. The ammonium salts can also be derived from aliphatic or cycloaliphatic amines such as monoethanolamine, diethanolamine or triethanolamine, propanolamine or cyclohexylamine. The component (e) merely serves to control the viscosity and the viscosity-shear behaviour of the printing thickeners and thereby to suit them to the desired processing method, for example hand screen printing or printing with rotary printing machines.

The printing pastes to be used according to the invention are advantageously manufactured by preparing a so-called pre-solution from the components (a), (b), (c) and optionally (e), which is subsequently slowly treated, whilst stirring, with an aqueous solution of urea and the alkalis required for fixing the reactive dyestuffs, for example sodium carbonate or sodium bicarbonate. It is also possible to stir the pre-solution into the aqueous, optionally alkaline, urea solution, but in that case a high speed stirrer and a somewhat longer time are required.

Instead of starting from the final alkali salts or ammonium salts of the fatty acids it is also possible to manufacture the pre-solution by starting from the free fatty acids and then to neutralise these, in the pre-solution, with ammonia or the appropriate amines.

The amounts in which the components (a), (b), (c), (d) and optionally (e) are employed, are usually:

a. 0.4 to 2% by weight,
b. 1.5 to 4, preferably 1.8–3.5% by weight,
c. 2 to 4.5, preferably 2.5–4.0% by weight,
d. 5 to 18, preferably 10–15% by weight and
e. 0 to 0.5, preferably 0 to 0.25% by weight, relative to the total weight of the printing paste.

After stirring the components (a) to (d) or (a) to (e) together, a glassy, translucent thickened emulsion is obtained, into which now only the dyestuff remains to be introduced, for example by sprinkling in and stirring.

The reaction dyestuffs and/or direct dyestuffs to be used in the emulsion printing paste according to the invention are the reactive dyestuffs and direct dyestuffs usually employed for printing cellulosic materials.

Such reactive dyestuffs have been defined, for example, by J. Wegmann in the Journal "Textilpraxis" of October 1958, on page 1056. The dyestuffs can belong to the class of the anthraquinone, azo, disazo, methine, azaporphine, oxazine and thiazine dyestuffs and can contain, as fibre-reactive groups, reactive groups of the most diverse kind, for example halogenotriazine, halogenopyrimidine, acryloyl, dichloroquinoxaline, dichloropyridazine, methylsulphonylpyrimidine, vinylsulphone and β-hydroxyethanesulphonic acid ester groups.

The direct dyestuffs to be used in the printing pastes according to the invention are the customary direct dyestuffs used for dyeing cellulosic materials as are described, for example, in the Colour Index, 2nd edition, 1956, Volume 2, pages 2001 to 2360.

The printing thickeners to be used according to the invention show all technological advantages of the thickened emulsions, such as absence of body and good running properties. However, they show significant advantages over the known thickened emulsions. Because of their extremely low content of hydrocarbons—hitherto the hydrocarbon content in thickened emulsions was at least 5%—their use presents practically no ventilation problems. Their hydrocarbon content is so low that it lies below the limit demanded in regulations relating to evolution of materials. Furthermore, the printing thickeners to be used according to the invention can be diluted with water in any ratio, in contrast to the known thickened emulsions. Hence, when they are used, there are no difficulties in cleaning the printing tools, such as doctor blades, printing screens and printing rollers. The equipment can be cleaned effortlessly with water, without conjointly using organic solvents. Furthermore, the printing pastes according to the invention are distinguished in that they can be washed out substantially more easily after fixing of the dyestuff, not only in the customary rinse with water, but also in the new rinsing processes which, in order to reduce the amount of contaminated water produced, employ organic water-immiscible solvents, such as chlorinated hydrocarbons, for example tetrachloroethylene, in rinsing prints. A further technological advantage of the printing thickeners according to the invention is that the dyestuffs can be sprinkled in without first being dissolved in water and nevertheless homogeneous printing pastes are obtained.

It should be pointed out that the printing pastes according to the invention are not only suitable for printing cellulose textile materials but also for printing cellulosic mixed woven fabrics and knitted fabrics, for example cellulose-polyester mixed woven fabrics. In that case, the dyestuffs customary for printing the other fibre materials, for example dispersion dyestuffs, are incorporated into the printing pastes additionally to the reactive dyestuffs and/or direct dyestuffs. These dispersion dyestuffs can belong to the most diverse classes, for example to the class of the anthraquinone, monoazo and diazo, nitro, quinophthalone, methine and azomethine dyestuffs. These sensitive dyestuffs and their fixing to the fibre can be handled particularly favourably with the printing thickeners according to the invention.

The parts used in the examples which follow are parts by weight, unless otherwise stated; the dyestuff numbers are those given in the Colour Index, 2nd edition, 1956, Volume 3.

PRINTING THICKENER 1

920 Parts of a solution prepared from 150 parts of urea, 25 parts of sodium bicarbonate, 10 parts of m-nitrobenzenesulphonic acid (Na salt) and 735 parts of water are emulsified, by means of a high speed stirrer, in 80 parts of a solution prepared from 18 parts of oleic acid, 4 parts of white oil, 20 parts of isooctyl alcohol, 34.5 parts of heavy benzine and 3.5 parts of monoethanolamine. A glassy, highly viscous emulsion is obtained, which is distinguished by excellent solvent properties for dyestuffs and outstanding shear characteristics.

PRINTING THICKENER 2

935 Parts of a solution prepared from 150 parts of urea, 25 parts of sodium bicarbonate and 760 parts of water are emulsified by means of a high speed stirrer in 50 parts of a solution of 15 parts of oleic acid, 20 parts of isooctyl alcohol, 15 parts of heavy benzine and 15 parts of ammonia (25% strength aqueous solution). A glassy, viscous emulsion is obtaned, which is distinguished by excellent solvent capacity for dyestuffs. The shear characteristics of the printing pastes prepared with the aid of this printing thickener are excellent.

PRINTING THICKENER 3

920 Parts of a solution prepared from 150 parts of urea, 25 parts of sodium bicarbonate, 10 parts of m-benzenesulphonic acid (Na salt) and 735 parts of water are emulsified, with stirring, in 80 parts of a solution prepared from 20 parts of ricinoleic acid, 3 parts of white oil, 25 parts of n-hexyl alcohol, 30 parts of heavy benzine and 2 parts of monoethanolamine. A highly viscous emulsion is obtained, which is distinguished by excellent capacity to dissolve dyestuffs and very good shear characteristics.

If, in this printing thickener, the ricinoleic acid is replaced by one of the known water-soluble emulsifiers, for example a water-soluble ethoxylation product of castor oil (for example from 1 mol of castor oil + 30 mols of ethylene oxide) a very good emulsion is admittedly obtained but this has such a low viscosity that it cannot be used as a printing thickener.

PRINTING THICKENER 4

920 Parts of a solution prepared from 150 parts of urea, 25 parts of sodium bicarbonate, 10 parts of m-nitrobenzenesulphonic acid (Na salt) and 735 parts of water are emulsified, whilst stirring, in 80 parts of a solution prepared from 20 parts of rape oil fatty acid (mixture of oleic acid and erucic acid), 4 parts of white oil, 20 parts of isooctyl alcohol, 30 parts of heavy benzine, 2 parts of monoethanolamine and 4 parts of oleyltauride. The formation of the emulsion already starts during the emulsification process. The processing characteristics of the printing pastes prepared with the printing thickener are excellent. Because of the ease with which the printing thickener can be washed out, very clear prints are also obtained after printing and fixing and washing.

PRINTING THICKENER 5

930 Parts of a solution prepared from 150 parts of urea, 25 parts of sodium bicarbonate, 10 parts of m-nitrobezenesulphonic acid (Na salt) and 745 parts of water are emulsified, with stirring, in 70 parts of a solution prepared from 10 parts of coconut oil first runnings fatty acid (predominantly $C_{10}$–$C_{12}$ fatty acids), 25 parts of isooctyl alcohol, 30 parts of heavy benzine and 5 parts of monoethanolamine. An excellent emulsion printing thickener is obtained.

If in this printing thickener the coconut oil first runnings fatty acid is replaced by one of the known water-insoluble emulsifiers, for example a fatty alcohol ethoxylation product (for example from 1 mol of fatty alcohol + 5 mols of ethylene oxide), then on stirring the aqueous urea solution into the pre-solution a water/oil emulsion which progressively becomes thicker and which is only capable of taking up a part of the urea solution is obtained. The emulsion is so inhomogeneous that it cannot be used as a printing thickener.

EXAMPLE 1

50 Parts of the reactive dyestuff of the formula (I) are stirred into 950 parts of printing thickener 1 by means of a high speed stirrer. During the stirring process, the dyestuff dissolves in the printing thickener.

Mercerised heavy cotton fabric is printed on a roller printing machine with the printing paste thus prepared. The fabric is then dried as usual and thereafter the dyestuff is fixed in a steamer for 8 minutes at 101° to 103° C. Thereafter the print is rinsed first cold, then hot and then again cold, and is then dried. The resulting print is distinguished by sharp-cut contours, high brilliance and evennes, and also by good fastness to rubbing and a soft handle.

During printing, the printing paste can be doctored off very well, and the gravure cells empty perfectly, without clogging.

If the print, instead of being rinsed in aqueous liquors, is rinsed inperchloroethylene liquors as described in German Offenlegungsschrift (German Published Specification) No. 1,945,965, a print is obtained which is distinguished by a substantially softer handle than the prints produced using the customary alginate thickeners.

An equivalent printing paste was also obtained if instead of the printing thickener 1 employed the same amount of printing thickener 3 or 4 was used.

EXAMPLE 2

30 Parts of the reactive red dyestuff of the formula (II), in the form of a powder, are sprinkled into 970 parts of the printing thickener 1, whilst stirring. The dyestuff already dissolves in the stock emulsion during the stirring process. Cotton towelling fabric is printed on a flat-bed screen printing machine with the printing paste thus prepared. Thereafter the fabric is dried in a customary drying apparatus, and it should be emphasised that during drying no migration of the dyestuff into unprinted parts of the fabric takes place. Thereafter, the dyestuff is fixed by 3 minutes' hot air treatment at about 160° C. The fabric is then washed in the usual manner on an open-width washing machine and is subsequently dried. A clear, uniform print distinguished by sharp contours and good resistance to rubbing and fastness to washing is obtained. The fabric furthermore has a pleasant soft handle.

The printing paste used is distinguished by excellent ease of doctoring; the screen does not clog and the print-through into the bulky, heavy fabric takes place effortlessly without the need to increase the number of sweeps of the doctor blade.

Equivalent prints were also obtained if instead of the dyestuff (II) employed, the same amount of the dyestuff (III) or of the dyestuff C.I. Direct Red 46 (C.I. 23,050) was employed.

Equivalent printing pastes were also obtained if instead of the printing thickener used, the same amount of printing thickener 2 was employed.

EXAMPLE 3

40 Parts of the reactive blue dyestuff of the formula (IV) (in the form of a powder) are stirred into 960 parts of the printing thickener 1 by means of a high speed stirrer. During the stirring process solution of the dyestuff occurs. A fabric of regenerated cellulose is printed with the printing paste thus obtained on a rotary screen printing machine. Feeding the printing paste into the rotary screen, which takes place by means of a pump, presents no difficulty and takes place like a pumping process with conventional thickeners. During the printing process, the perforations of the screen do not clog. The sweep of the doctor blade, and the doctoring-off of the printing paste, are perfect. The printed pattern has sharpy cut contours.

After printing, the fabric is dried. The dyestuff is subsequently fixed for 8 minutes in a continuous festoon steamer at 101° to 103° C. Thereafter it is washed and dried in the usual manner. The resulting print is distinguished by a brilliant clear contour shade and a soft handle.

An equivalent print was obtained if instead of the dyestuff employed the same amount of the dyestuff of the formula (V) or of the dyestuff C.I. Direct Blue 15 (C.I. 24,400 ) was employed.

An equivalent printing paste and an equivalent print were furthermore obtained if instead of the printing thickener employed, the same amount of the printing thickener 4 or 6 was used.

EXAMPLE 4

35 Parts of the reactive blue dyestuff of the formula (VI) (powder form) are stirred into 965 parts of the printing thickener 1 by means of a high speed stirrer. Whilst being stirred in, the dyestuff dissolves in the printing thickener. A mercerised cotton fabric is printed, as described in Example 3, with the printing paste thus produced. After the customary drying, the dyestuff is fixed in a two-stage process, with the printed and dried goods first passing through a strongly alkaline liquor containing salt, such as is used in two-stage fixing processes for reactive dyestuffs, then being squeezed out on a twin-roll padder to about 70 to 80% weight increase and, after a short path in air at about 135° C, being fixed by 30 seconds' steaming in an appropriate apparatus. Immediately after fixing, the goods are continuously washed and dried. A sharp even print is obtained, which is distinguished by good brilliance and a perfect white background in the unprinted areas of the fabric. The printing paste can be doctored off very well during printing and the gravure cells empty perfectly, without clogging.

Equivalent printing pastes and prints were also obtained if instead of the printing thickener 1 employed, the same amount of the printing thickener 2, 3, 5 or 6 was employed.

EXAMPLE 5

60 Parts of the reactive dyestuff of the formula (VII) (powder form) were stirred by means of a high speed stirrer into 940 parts of the printing thickener 1. Whilst being stirred in, the dyestuff dissolves in the stock emulsion. Mercerised cotton fabric is printed with the printing paste thus obtained on a roller printing machine. After the customary drying, the dyestuff is fixed by the alkali shock process which is customary for fixing reactive dyestuffs. No staining is observed; the alkaline shock bath is also not stained. After the usual washing, a uniform sharp print is obtained, which is distinguished by high brilliance, a clean white background and good rub resistance and fastness to wet processing. The fabric furthermore has a soft pleasant handle.

If instead of the 60 g of the reactive dyestuff of the formula (VII) 100 g of the dyestuff of the formula (VIII) were used and instead of 940 parts only 900 parts of the printing thickener 1 were employed, a deep, even, sharp black print was obtained, which is also distinguished by good rub resistance and fastness to wet processing.

EXAMPLE 6

30 Parts of the reactive blue dyestuff of the formula (IV) and 40 parts of the blue dispersion dyestuff of the formula (IX) are stirred into 930 parts of printing thickener 1 by means of a high speed stirrer. A polyester-cotton mixed fabric (67/33) is printed on a roller printing macine with the printing paste thus obtained. During the printing process, the printing paste can very easily be doctored off and the gravure cells empty perfectly. After the customary dyring, the dyestuff is fixed by heating to 195° C for 1 minute. The print is then rinsed, first cold, then hot and then again cold, and is subsequently dried. The print thus obtained is distinguished by sharp contours, high brilliance and a clean white background.

Structures of the dyestuffs used in the Examples (I)
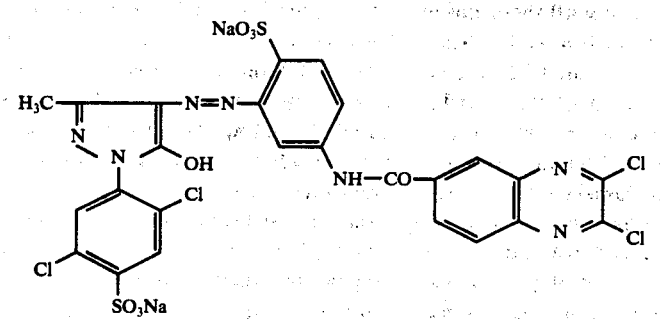
French Patent 1,389,345, Example 3
(II)
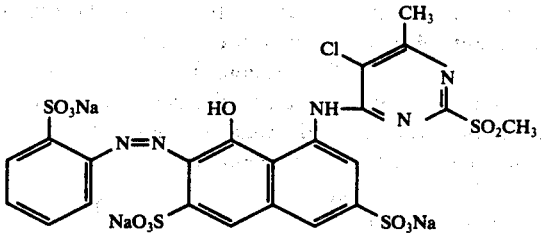
(III)
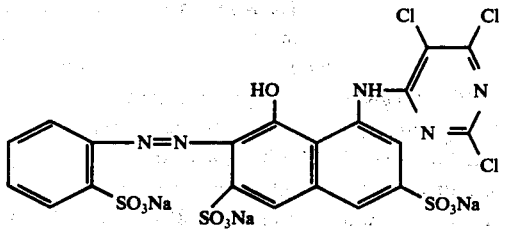
C.I. 18155
(IV)
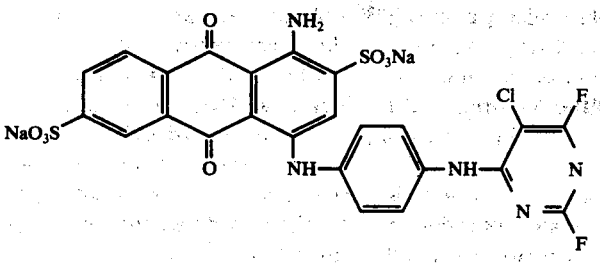
U.S. Pat. No. 3,669,951
(V)
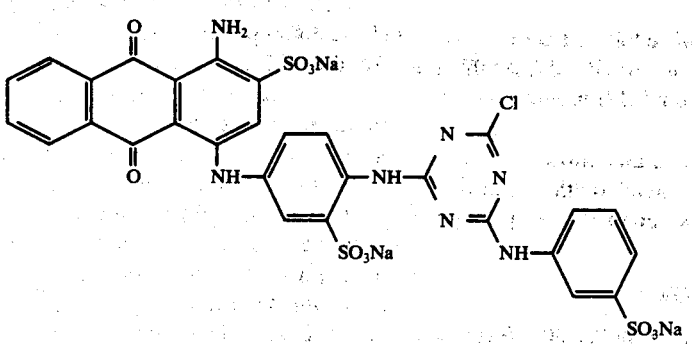
C.I. 61211

-continued

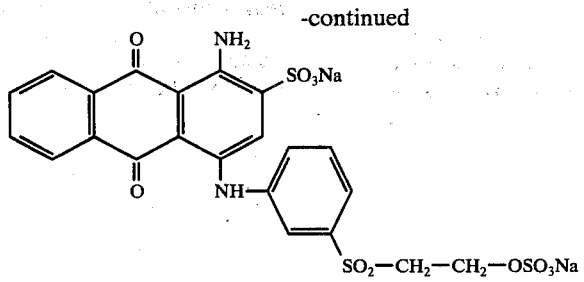

(VI)

C.I. 61200

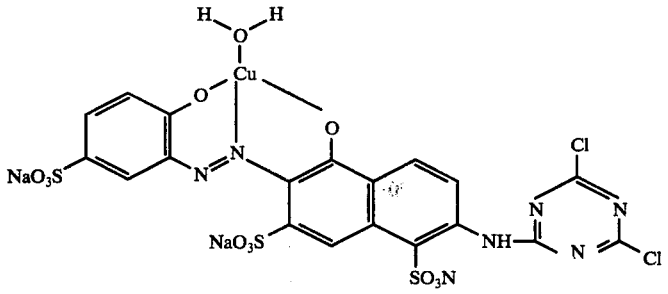

(VII)

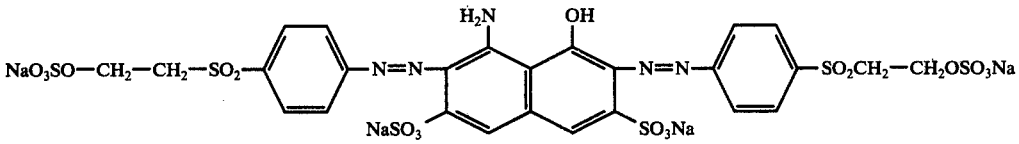

(VIII)

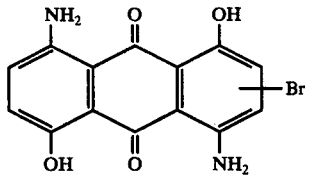

(IX)

U.S. Pat. No. 2,990,413, Example 3

We claim:

1. In the process for printing cellulosic fibre materials with reactive dyestuffs and/or direct dyestuffs using emulsion thickeners, the improvement comprising using emulsion printing pastes which contain, in addition to the dyestuffs and the alkali required for fixing the reactive dyes a. 0.4 to 2% by weight of an alkali salt of a saturated or unsaturated fatty acid having 8 to 22 carbon atoms, ammonium salt of a saturated or unsaturated fatty acid having 8 to 22 carbon atoms or a mixture of said salts;

b. 1.5 to 4% by weight of an aliphatic alcohol having 5 to 18 carbon atoms;

c. 2 to 4.5% by weight of a largely straight-chain, liquid paraffin hydrocarbon;

d. 5 to 18% by weight urea; and e. 0 to 0.5% by weight of a salt comprising the alkali, ammonium, monoethanolamine, diethanolamine, triethanolamine, propanolamine or cyclohexylamine salt of a sulfonic acid wherein said sulfonic acid contains a substantially unbranched alkyl chain and is selected for the group consisting of n-alkanesulfonic acids, n-alkylbenzenesulfonic acids, α-sulfofatty acid esters and acyl taurides.

2. Process according to claim 1 wherein the components (b), (c), (d) and (e) are employed in the following amounts:

b. 1.8 to 2.5% by weight c. 2.5 to 4% by weight d. 10 to 15% by weight e. 0 to 0.25% by weight relative to the total weight of the printing paste.

3. Process according to claim 1 wherein an alkali salt and/or ammonium salt of oleic acid is used as component (a).

4. Process according to claim 1 wherein heavy benzine of boiling point 170°-250° C is employed as component (c).

5. Printing pastes according to claim 1, containing components (b), (c), (d) and (e) in the following amounts:

b. 1.8 to 2.5% by weight c. 2.5 to 4% by weight d. 10 to 15% by weight e. 0 to 0.25% by weight relative to the total weight of the printing paste.

6. Printing paste for printing cellulosic fibre materials with reactive dyestuffs and/or direct dyestuffs which contain, in addition to the dyestuffs and the alkali required for fixing the reactive dyestuffs a. 0.4 to 2% by weight of an alkali salt of a saturated or unsaturated fatty acid having 8 to 22 carbon atoms, ammonium salt of a saturated or unsaturated fatty acid having 8 to 22 carbon atoms or a mixture of said salts;

b. 1.5 to 4% by weight of an aliphatic alcohol having 5 to 18 carbon atoms;

c. 1 to 4.5% by weight of a largely straight-chain, liquid paraffin hydrocarbon;

d. 5 to 18% by weight urea; and e. 0 to 0.5% by weight of a salt comprising the alkali, ammonium, monoethanolamine, diethanolamine, triethanolamine, propanolamine or cyclohexylamine salt of a sulfonic acid wherein said sulfonic acid contains a substantially unbranched alkyl chain and is selected for the group consisting of n-alkanesulfonic acids, n-alkylbenzenesulfonic acids, α-sulfofatty acid esters and acyl taurides.

* * * * *